US005414969A

United States Patent [19]

Krejci et al.

[11] Patent Number: 5,414,969

[45] Date of Patent: May 16, 1995

[54] DECORATIVE MAGNETIC ELEMENTS FOR CEILING GRIDS

[75] Inventors: Kevin S. Krejci, Clearwater; Bernard J. Einhaus, Palm Harbor, both of Fla.

[73] Assignee: The Celotex Corporation, Tampa, Fla.

[21] Appl. No.: 195,181

[22] Filed: Feb. 14, 1994

[51] Int. Cl.[6] ..... E04C 2/00; E04B 9/34

[52] U.S. Cl. ..... 52/311.3; 52/469; 52/506.07; 52/716.1; 52/717.03; 52/717.04; 52/DIG. 4; 52/DIG. 8; 52/741.1; 156/71

[58] Field of Search ..... 52/DIG. 4, DIG. 8, 311.1, 52/311.3, 465, 469, 716.1, 717.03–717.06, 506.07, 741.1; 156/71; 428/900

[56] References Cited

U.S. PATENT DOCUMENTS

| | | | |
|---|---|---|---|
| 3,124,725 | 3/1964 | Leguillon | 428/900 X |
| 3,341,996 | 9/1967 | Jones et al. | 52/DIG. 4 X |
| 3,583,119 | 6/1971 | Kann . | |
| 4,115,970 | 9/1978 | Weinar . | |
| 4,189,888 | 2/1980 | Blitzer, Jr. . | |
| 4,366,637 | 1/1983 | Dechamps | 40/621 |
| 4,452,021 | 6/1984 | Anderson . | |
| 4,690,446 | 9/1987 | Warren | 293/128 |
| 4,709,522 | 12/1987 | Carnahan . | |
| 4,742,662 | 5/1988 | Smith . | |
| 4,747,246 | 5/1988 | Sanborn . | |
| 4,848,054 | 7/1989 | Blitzer et al. | 52/DIG. 8 X |
| 5,077,950 | 1/1992 | Bretches et al. . | |
| 5,265,393 | 11/1993 | Bischel | 52/DIG. 8 X |

FOREIGN PATENT DOCUMENTS

| | | | |
|---|---|---|---|
| 1043272 | 9/1966 | United Kingdom | 52/DIG. 4 |

*Primary Examiner*—Carl D. Friedman
*Attorney, Agent, or Firm*—Charles W. Vanecek

[57] ABSTRACT

A suspended ceiling assembly is provided with its metallic runners covered with magnetic articles, which may be discrete or continuous members. The magnetic articles comprise an outer facing layer and an inner magnetic layer, and are conformed to fit over and embellish the runners. Preferably, the outer facing layer comprises a plastic material and the inner magnetic layer comprises a ferromagnetic material and a binder.

14 Claims, 2 Drawing Sheets

DECORATIVE MAGNETIC ELEMENTS FOR CEILING GRIDS

BACKGROUND OF THE INVENTION

1. Field of the Invention

This invention relates to magnetic elements for the decoration of suspended ceiling systems, and more particularly to magnetic elements for the decorative covering of an existing metal T-rail system.

2. Description of the Prior Art

Structural panels used in forming interior ceilings of buildings are generally comprised of gypsum boards, wet felted fibrous boards, slab structures of melt-spun mineral fibers, panels of interadhered wood chips, and other well known materials. Such panels are commonly held by a grid-type framework which supports them at their peripheral edges. The framework consists of a network of intersecting ceiling runners.

This supporting framework is fabricated principally from metal stock which can contribute a mechanical, austere or inexpensive appearance to the ceiling. Other disadvantages associated with a metal gridwork are its susceptibility over time to pickup of smoke film, dirt and other disfiguring matter and to rusting, chipping and flaking. The resulting unsightliness of the gridwork can give the entire ceiling a dull, dingy, and off color appearance.

In order to enhance the aesthetic appeal of suspended ceilings employing such grid patterns, a variety of approaches has been adopted. One such approach has been to cover the exposed surface of the T-bar flange with a flat strip of metal. Flat strips of vinyl fabric have also been used. Alternatively, molded elements have been fashioned for the T-rail system to provide a decorative three-dimensional design, as illustrated in U.S. Pat. No. 4,189,888.

Various ways of attaching the coverings to the metal rails have been devised. Examples are the use of adhesive bonding and the configuration of the covering to clip on the rail. In U.S. Pat. No. 4,747,246, a multiplicity of imitation beams are attached to the T-grid elements through securement means embedded within the beams. The securement means may be a magnetic strip, a strip of hook and loop-pile fasteners, or a strip of adhesive material.

Although each of the prior art approaches has advantageous features for decoratively covering the metal gridwork of conventional suspended ceilings, there still remains a need for a simple and versatile structure having a broad applicability in decorating such systems.

OBJECTS OF THE INVENTION

It is therefore an object of the present invention to enhance the aesthetic appeal of the grid structure of a suspended ceiling system.

It is another object to provide a system to decoratively cover an existing metal ceiling grid in a simple, efficient and economical manner.

It is still another object to provide elements having magnetic attachment means for placement on and decoration of the metal ceiling runners of a grid structure.

It is yet another object to provide an easily handleable magnetic strip which is readily attachable to an existing T-style drop ceiling system for decoration of the system.

It is a further object to provide as a decorative covering for a suspended ceiling s metal grid a magnetic strip which can be applied to the grid with a minimum of disruption to the area covered by the suspended ceiling.

It is a still further object to decorate the grid elements of a suspended ceiling with a covering which may be readily removed from the ceiling at a later time.

It is a yet further object to provide a method for efficiently and economically changing the color of a ceiling grid, whereby complementary or contrasting colors may be introduced for enhanced decorative effects.

The above and yet other objects and advantages of the present invention will become apparent to those skilled in the art when the instant disclosure is read in conjunction with the accompanying drawings.

SUMMARY OF THE INVENTION

The above objects have been achieved by the provision of a decorative element with a magnetic attachment means for placement over the ceiling grid of a suspended ceiling system. When placed over the metallic runners of an existing grid, the decorative element creates a new visually appealing design in the ceiling grid system. An especially advantageous feature of the decorative element is its capacity to leave the grid unaltered, except for the imparted decorative effects. The element can be placed on the grid's main runners, cross runners and/or the intersections of the runners, i.e., anywhere on an existing grid to enhance its appearance. The decorative element, which is magnetized for secure attachment to the grid structure, can be formed of any material and into any size or shape which are compatible with the grid and aesthetically enhance it. The exposed surface of the decorative element can have any color, texture or combination thereof that make the element visually appealing when it is viewed from below. The decorative element can be rigid, flexible or semi-flexible.

In a preferred embodiment, the decorative element is an elongated strip which can be easily installed onto the grid structure of a conventional suspended ceiling. The strip is magnetic so that it is simply attachable to the metallic runners of the grid structure. The magnetic strip covers the runners and can be formed to present a myriad of attractive looks in place of the runner's otherwise austere appearance. The elongate strip provides a strong and extensive magnetic hold onto the entire expanse of grid covered. The strip preferably has a backing of plastic material containing particles having magnetic properties, the particles advantageously being uniformly distributed for enhanced holding power. The backing is advantageously faced with a visually appealing film, which can be formed of a variety of different plastic materials such as vinyl, for example. The strip can have curved edges which help to soften the hard metallic look of the grid.

The strip is particularly suited for the retrofitting of old grid ceilings whose exposed flange portions have developed an unattractive appearance. The retrofitting can be accomplished conveniently with little disturbance to the involved facilities. The elongate strip is simply placed in contact with the exposed flanges of the grid's metallic T-members and becomes magnetically attached.

In a preferred embodiment, the magnetic strip is flexible. Advantageously, the strip is sufficiently flexible so that it can be rolled up for easy transport to and application at a job site. The present invention thus provides in roll form a flexible strip which can have a length of approximately 100–300 feet and a width to match the grid s width, and weigh about 40 lbs. per roll for ready handleability in retrofitting applications.

DETAILED DESCRIPTION OF THE INVENTION

Figure 1:
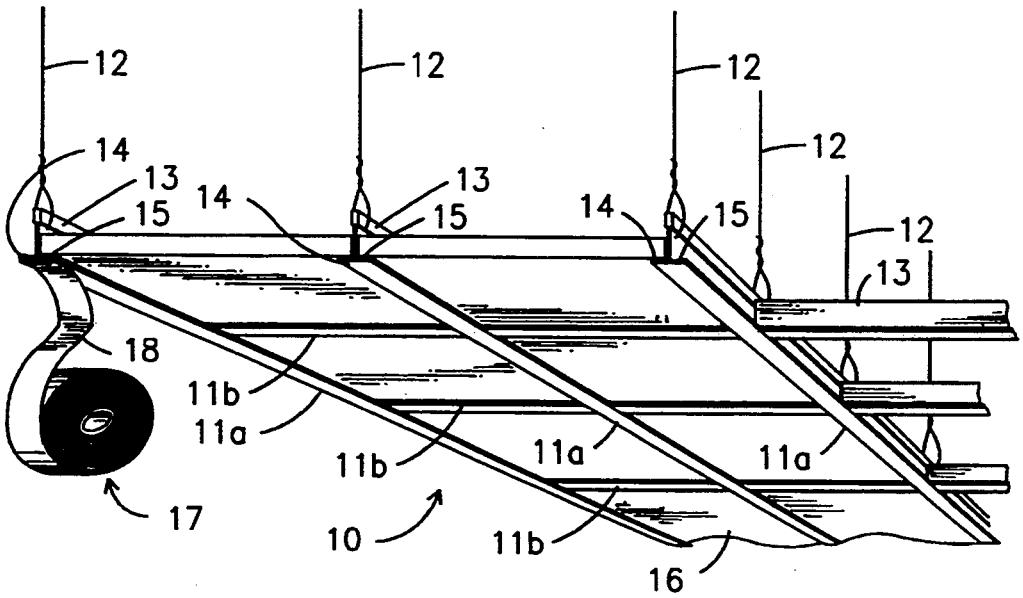
FIG. 1 is a fragmented perspective view of the magnetic strip of the invention as it is being attached to a ceiling grid.

A typical ceiling suspension grid 10 is shown in FIG. 1. The grid comprises T-shaped runners 11 suspended in a conventional manner by wires 12 from the permanent ceiling. Each T-shaped runner 11 includes a vertical portion 13 and horizontally disposed flanges 14 and 15 which extend to either side of the vertical portion. Ceiling panels 16 are supported on the flanges of the intersecting grid main runners 11*a* and cross runners 11*b*.

When initially installed, the runner's exposed flange portions, being freshly painted, form fairly attractive dividers between the supported panels 16. However, upon exposure over time to various environmental influences, such as smoke, dirt, high humidity, grease, etc., the metallic flanges may rust, become dirt and grease covered, become chipped, or may otherwise become unattractive. Disassembly and replacement of unsightly ceiling gridwork would involve considerable material and labor costs. Even to remedy the situation, where feasible, by removing panels 16, and cleaning and sometimes repainting the exposed grid surfaces would entail inconvenience, temporary loss of use of the facilities, and expense, with the possibility that the operation might have to be repeated within a short time.

The magnetic strip of the invention obviates such inconvenience and expense. It retrofits and beautifies an existing ceiling grid without the trouble and expense of taking it down and replacing it with a new grid, or removing the ceiling panels, repainting the grid and then replacing the panels. The simplicity of the present invention is illustrated in FIG. 1, which shows inventive embodiment 17 comprising a flexible elongate strip which can be supplied in a roll length of about 200 feet. Installation is achieved by simply unwinding strip 17 from the roll and placing it against the exposed metallic flanges 14, 15 of the runners 11.

Figure 2:
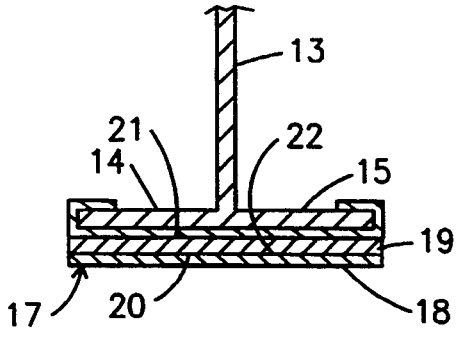
FIG. 2 is a side elevational view of the magnetic strip.
Figure 3:
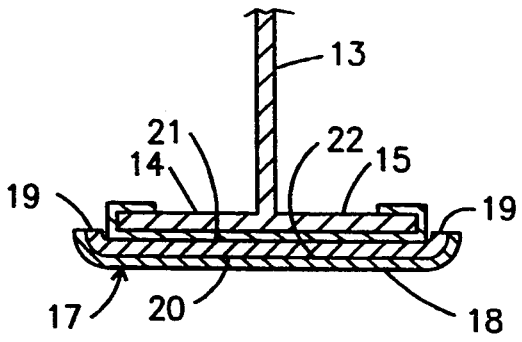
FIG. 3 is a side elevational view of a modified form of the magnetic strip.

As seen in FIG. 1, the positioning of strip 17 on main runner 11*a* is such that one major surface of the strip is exposed to view from below. This major surface is the outer face of the lower portion or layer 18 of strip 17, as shown in FIGS. 2 and 3. Layer 18 may be configured to offer a wide variety of attractive appearances, and may be composed of any conventional facing material. Typically, layer 18 may comprise woven or nonwoven materials of glass, carbon, plastics, or textile fibers; metal foils, for example, aluminum, copper, brass, gold or steel up to 1.5 mm thick; films made from polymers such as polyvinyl chloride, acrylo-butadiene-styrene, polyamide, polyester, polyethylene, polypropylene, sawdust-filled polypropylene, cellulose esters, and cellulose mixed esters; and cardboard or paper.

Figure 4:
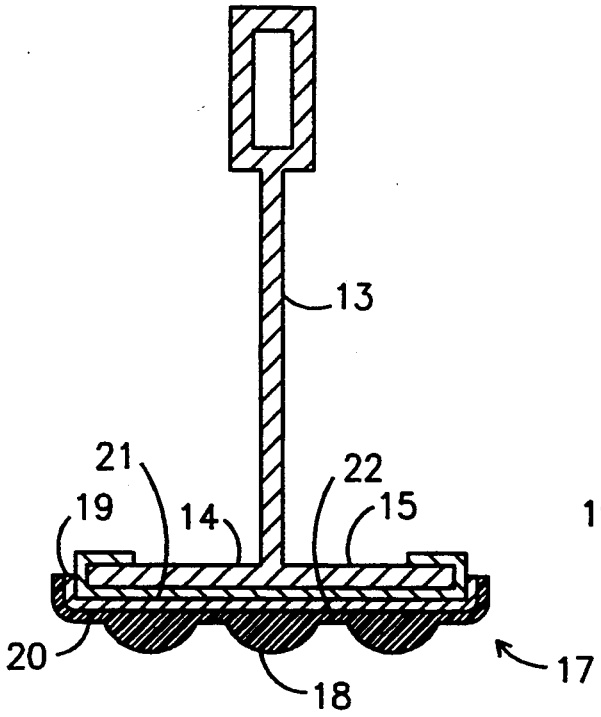
FIG. 4 is a side elevational view of another modified form of the magnetic strip.
Figure 5:
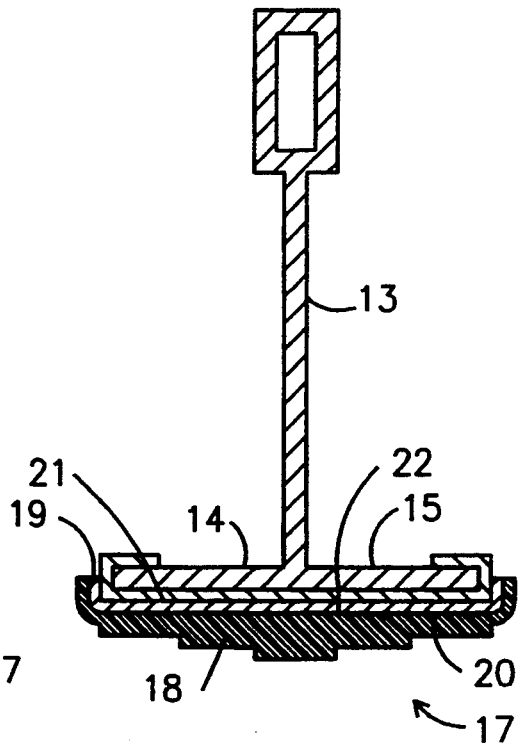
FIG. 5 is a side elevational view of still another modified form of the magnetic strip.

While in the inventive embodiments shown in FIGS. 2 and 3, exposed layer 18 has a relatively flat surface, the layer may be formed into a great variety of appealing shapes, two of which are shown in FIGS. 4 and 5. Where the layer is made from a thermoplastic resin, shaping of the softened resin can be simply accomplished by an extrusion process. Whether having a flat or variously shaped surface, layer 18 is advantageously a flexible or semi-flexible material. The layer is about 0.5–1 inch wide with a thickness of about 2–25 mils.

As illustrated in FIGS. 2–5, layer 18 is backed by and attached to magnetic portion or layer 19 of strip 17. Like layer 18, layer 19 can be a rigid or flexible material. However, in a highly preferred embodiment, portion 19 comprises a flexible or semi-flexible, permanent magnetic material which in combination with a similarly flexible, decorative coating 18 forms an easily manipulatable covering for a ceiling grid. Both the front surface 20 and back surface 21 of magnetic layer 19 are principally flat, with front surface 20 adhered to the complementarily flat back or unexposed surface 22 of layer 18.

There may be departures from complete flatness to achieve special structural objectives, particularly ornamental ones. For example, each of the two side edges of strip 17, comprising the edges of both layers 18 and 19, may be upturned to form a lip which extends around the respective side edges of flanges 14, 15, as seen in FIG. 3. This design contributes to a secure and flush fit of elongate strip 17 on the runner being covered and impedes viewing from below of the runner's side edges, thus enhancing the overall appearance of the retrofitted ceiling. The upturned edges of strip 17 shown in FIG. 3 offer an appealingly soft look in place of the hard metallic appearance of the grid's uncovered edges.

A particularly desirable decorative element 17 is a flexible magnetic strip having a top polymeric coating 18, which is suitably a vinyl material. Coating 18 may desirably contain a fire-retardant compound for enhanced flame-resistivity. Layer 19 typically comprises a ferromagnetic powder and a binder and in a preferred embodiment comprises a mix of hypalon, vistamix and ferrite. Coating layer 18 is laminated in a conventional manner to magnetic layer 19. A strong adhesion between layers 18 and 19 is developed through use of an aggressive adhesive such as an acrylic.

A preferred laminated magnetic strip of the invention having a thickness of 0.035", and a length of 200–300 lineal feet per roll is supplied by Flexmag Industries, Inc., Cincinnati, Ohio. The product is supplied in a 15/16" width for application over standard grid and in a $\frac{7}{8}$ width for application over narrow grid. Wall angle is covered with a 7/8" width material. Typical physical properties of the flexible magnetic strip are as follows:

| | |
|---|---|
| Patterns of Magnetization | Multiple-One Side |
| Flexibility | can be wrapped around a 1" radius without cracking at 68° F. |
| Machinability | diecutting, knifecutting, etc. with ease |
| Specific Gravity | 3.8 |

-continued

| Hardness | Shore D55 | |
|---|---|---|
| | Longitudinal | Transverse |
| Tensile | 922 lbs./sq.in. | 714 lbs./sq.in. |
| Elongation | 65% | 43% |
| Tear-graves | 155 lbs./in. | 172 lbs./in. |
| Tear-Elmendorf | 22 gm/mil | 27 gm/mil |
| Shrinkage | | |
| 158° F. 7 days | 1.5% | .4% |

The laminated magnetic strip 17 has outstanding holding power. To determine whether the magnetic strip loses adhesion to steel upon exposure to high temperature, it was subjected to a flame spread test (ASTM E84). Two of the magnetic strips were placed on and magnetically held by two, one-inch wide steel strips, fastened eight inches apart to a bare cement board. The test resulted in a flame spread of 4 and a smoke development of 0, which is a Class A performance. The strips functioned well without losing adherence except that about 6 inches of strip, at the place where the flame impinged directly, were charred to the point of brittleness, with some flaking off the steel during removal of the cement board from the test tunnel. The magnetic strips blackened for a distance of about 4–5 feet from the flame and blistered to a decreasing degree out to about 8–10 feet. Significantly, the charred sections of strip maintained their magnetism.

Installation of the magnetic strip is a relatively simple task. It can be easily cut with sharp scissors and a utility knife. The strip can appropriately be cut in roughly premeasured sizes for installation, with some additional material length provided for more precise trimming with a utility knife at the job site to ensure adequate coverage of the grid.

During the installation procedure, the weight of any slack in the strip, as it is being applied, may cause the strip to detach from the grid. Accordingly, it is a recommended practice to use clips to hold the strip to the grid, especially to its main runner and wall angle components, until its full length on the grid creates a strong magnetic hold. The clips can be moved progressively nearer the advancing point of application of the strip as it is being put in contact with the grid.

The laminated magnetic strip 17 of the invention provides an excellent means to easily and attractively cover old, soiled and discolored grid without the inconvenience and expense of buying and installing new grid structures. Soiled and discolored grid can be covered virtually as is. The installer should simply remove from the grid any large raised particles of dirt and other materials to provide a uniformly smooth appearance. Installation is facilitated because the magnetic strip 17 is configured so that its back surface 21 neatly aligns with and fits over the grid runner. Furthermore, the strip can be installed without removing the existing ceiling panels. With ceiling panels whose edge configurations obstruct installation, the panels may have to be lifted slightly to insure that the edges of the magnetic strip are fully congruent with and adhered to the edges of the grid's runners. In the case of the inventive embodiment shown in FIG. 3, the strip can be moved over the runner until a snap is heard and its upturned edges are locked securely around the edges of the runner.

Figure 6:
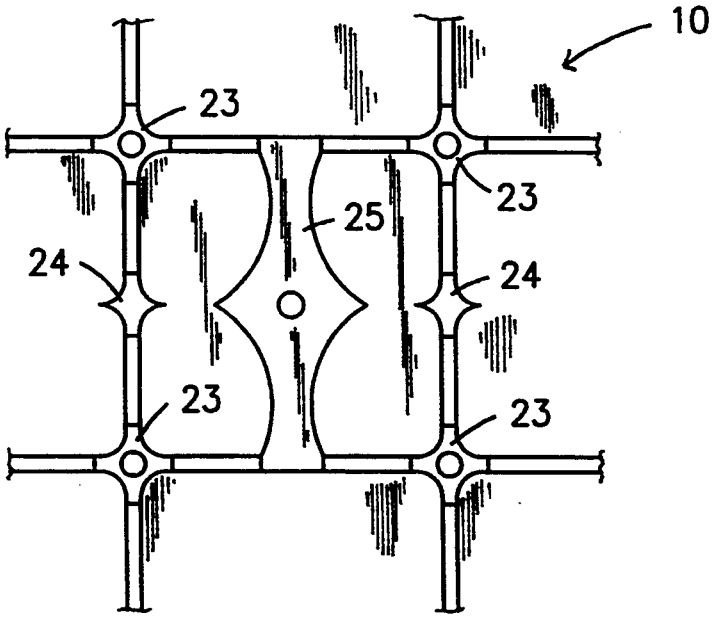
FIG. 6 is a bottom plan view of further decorative elements of the invention (viewed from below when installed on a ceiling grid).

In FIG. 6, there are illustrated embodiments of the present invention wherein individual rather than elongate decorative elements are placed at various locations over the grid to create a new design in the ceiling grid's system. The magnetically-backed elements can be placed anywhere along or across the grid system. The elements shown in FIG. 6 are discrete members located at specific locations on the grid, unlike strip 17 which extends continuously along the grid's length. Decorative elements 23 are shown at intersections of the grid runners while elements 24 are at the runner's midpoints and element 25 spans two runners. The elements can comprise any suitable material having a magnetic backing and can have various sizes and shapes. In a preferred embodiment, the elements are rigid or semi-rigid. Any pleasing color and/or texture may be chosen for the elements' surface to contribute to the overall decorative effect. Decorative elements 23, 24 and 25 may each suitably have a facing layer and magnetic backing which are composed of materials similar to the materials forming layers 18 and 19, respectively, of strip 17.

Those skilled in the art to which the invention relates will appreciate that other substitutions and modifications can be made to the described embodiments, without departing from the spirit and scope of the invention as described by the claims below.

We claim:

1. A suspended ceiling assembly which comprises a network of parallel extending metallic main runners and parallel extending metallic cross runners, the main and cross runners intersecting and being arranged in a geometric pattern to form a series of rectangular openings for ceiling panels, each of the runners having a cross-sectional, inverted T-shape with a vertical web and a horizontal flange extending to either side of the vertical web, and each of the runners having the normally exposed lower surface of its horizontal flanges covered by an elongated magnetic strip, each of which strips (a) being flexible and having a width and length which match the width and length of the exposed lower surface of the flanges being covered, the flexibility of each strip being sufficient so that the strip can be unwound from a roll for easy application to the flanges, and (b) comprising an outer facing layer and an inner magnetic layer.

2. The suspended ceiling assembly of claim 1 wherein the outer facing layer of the elongated magnetic strip has a flat or variously shaped decorative surface.

3. The suspended ceiling assembly of claim 2 wherein the outer facing layer comprises a plastic material and the inner magnetic layer comprises a ferromagnetic material and a binder.

4. The suspended ceiling assembly of claim 3 wherein the outer facing layer and inner magnetic layer are secured together by an adhesive.

5. The suspended ceiling assembly of claim 3 wherein the inner magnetic layer comprises a mixture of hypalon, vistamix and ferrite.

6. The suspended ceiling assembly of claim 3 wherein the outer facing layer comprises a vinyl polymer.

7. The suspended ceiling assembly of claim 6 wherein the vinyl polymer contains a fire-retardant compound.

8. The suspended ceiling assembly of claim 2 wherein the width of the outer facing layer of the elongated magnetic strip matches the width of its inner magnetic layer.

9. The suspended ceiling assembly of claim 8 wherein the outer facing layer comprises a plastic material and the inner magnetic layer comprises a ferromagnetic material and a binder.

10. The suspended ceiling assembly of claim 9 wherein each of the two side edges of the elongated magnetic strip is upturned to form a lip which extends around the corresponding side edges of the horizontal flanges of the runner being covered.

11. The suspended ceiling assembly of claim 9 wherein the outer facing layer comprises a vinyl polymer.

12. The suspended ceiling assembly of claim 9 wherein the inner magnetic layer comprises a mixture of hypalon, vistamix and ferrite.

13. A process of retrofitting a suspended ceiling structure which has a network of parallel extending metallic main runners and parallel extending metallic cross runners, the main and cross runners intersecting and being arranged in a geometric pattern to form a series of rectangular openings for ceiling panels, each of the runners having a cross-sectional, inverted T-shape with a vertical web and a horizontal flange extending to either side of the vertical web, the process comprising (a) providing an elongated magnetic strip in roll form for application to the horizontal flanges of the runners, the strip comprising an outer facing layer and an inner magnetic layer, (b) unwinding the strip from the roll, the strip being sufficiently flexible so that it can be unrolled for easy application, and (c) contacting the normally exposed lower surface of the horizontal flanges of each of the runners with the inner magnetic layer of the strip, the strip having a width and length which match the width and length of the exposed lower surface of the flanges being contacted, whereby the inner magnetic layer of the strip becomes magnetically attached upon contact to the lower surface of the horizontal flanges of the metallic runners.

14. The process of claim 13, further comprising employing clips to hold the elongated magnetic strips to the contacted runners during application.

* * * * *